US008286459B2

(12) United States Patent
Kubo et al.

(10) Patent No.: US 8,286,459 B2
(45) Date of Patent: Oct. 16, 2012

(54) METHOD FOR PRODUCING TWO-PIECE CAN AND TWO-PIECE LAMINATED CAN

(75) Inventors: Hiroshi Kubo, Tokyo (JP); Katsumi Kojima, Tokyo (JP); Yuka Nishihara, Tokyo (JP); Yoshihiko Yasue, Tokyo (JP); Hiroki Iwasa, Tokyo (JP)

(73) Assignee: JFE Steel Corporation (JP)

( * ) Notice: Subject to any disclaimer, the term of this patent is extended or adjusted under 35 U.S.C. 154(b) by 1247 days.

(21) Appl. No.: 11/990,374

(22) PCT Filed: Aug. 10, 2006

(86) PCT No.: PCT/JP2006/316118

§ 371 (c)(1),
(2), (4) Date: Feb. 12, 2008

(87) PCT Pub. No.: WO2007/020948

PCT Pub. Date: Feb. 22, 2007

(65) Prior Publication Data

US 2009/0218250 A1 Sep. 3, 2009

(30) Foreign Application Priority Data

Aug. 12, 2005 (JP) ..... 2005-234560

(51) Int. Cl.
*B21D 11/00* (2006.01)
*B21D 22/00* (2006.01)

(52) U.S. Cl. ..... 72/379.4; 72/348

(58) Field of Classification Search ..... 72/46, 342.1, 72/347–349, 379.4; 413/67
See application file for complete search history.

(56) References Cited

U.S. PATENT DOCUMENTS

| | | | | |
|---|---|---|---|---|
| 5,179,854 | A | 1/1993 | Matsui et al. | |
| 5,753,328 | A * | 5/1998 | Miyazawa et al. | 72/46 |
| 5,778,723 | A * | 7/1998 | Diekhoff | 72/356 |
| 5,803,301 | A | 9/1998 | Sato et al. | |
| 2001/0031327 | A1 | 10/2001 | Sato et al. | |

(Continued)

FOREIGN PATENT DOCUMENTS

DE 199 02 045 A1 8/1999

(Continued)

OTHER PUBLICATIONS

Machine translation of JP06031362A, Oyagi et al., pp. 1-7.*

*Primary Examiner* — Teresa M Ekiert
(74) *Attorney, Agent, or Firm* — DLA Piper LLP (US)

(57) ABSTRACT

In a method for producing a two-piece can, a circular disk of a laminated steel sheet having a thermoplastic resin coating layer is subjected to multistage forming to produce a final formed body having a height h, a maximum radius r, and a minimum radius d (the case where r is equal to d is also included). Forming is performed so that the height h, maximum radius r, and minimum radius d of the final formed body satisfy the relationships $0.1 \leqq d/R \leqq 0.25$ and $1.5 \leqq h/(R-r) \leqq 4$ with respect to a radius R of a circular disk before forming whose weight is equal to that the final formed body. At an intermediate stage of forming, a formed body is subjected to heat treatment at a temperature of not less than a melting point of a thermoplastic resin but not more than a temperature 30° C. higher than the melting point.

15 Claims, 1 Drawing Sheet

U.S. PATENT DOCUMENTS

| | | | |
|---|---|---|---|
| 2003/0049671 | A1 | 3/2003 | Hillebrand et al. |

FOREIGN PATENT DOCUMENTS

| | | | | |
|---|---|---|---|---|
| JP | 59-35344 | A | | 2/1984 |
| JP | 61-22626 | A | | 1/1986 |
| JP | 4 091825 | A | | 3/1992 |
| JP | 06031362 | A | * | 2/1994 |
| JP | 7-106394 | A | | 4/1995 |
| JP | 2526725 | B2 | | 6/1996 |
| JP | 8-309465 | A | | 11/1996 |
| JP | 2001-246695 | A | | 9/2001 |
| JP | 2004-148324 | A | | 5/2004 |

* cited by examiner

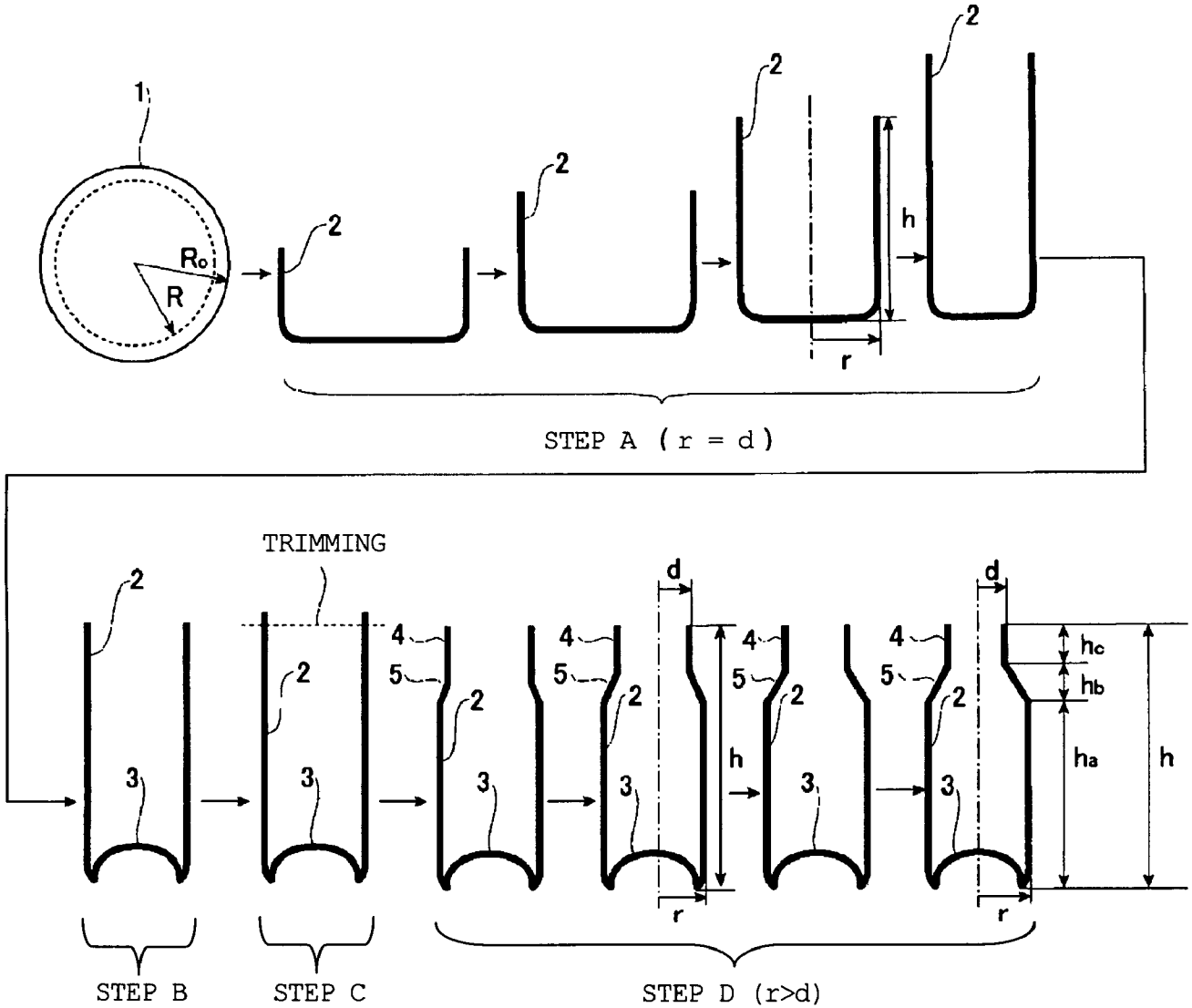
1
2
R
Ro
h
r
STEP A ( r = d )
TRIMMING
3
4
5
d
hc
hb
ha
STEP B
STEP C
STEP D (r>d)

METHOD FOR PRODUCING TWO-PIECE CAN AND TWO-PIECE LAMINATED CAN

RELATED APPLICATION

This is a §371 of International Application No. PCT/JP2006/316118, with an international filing date of Aug. 10, 2006 (WO 2007/020948 A1, published Feb. 22, 2007), which is based on Japanese Patent Application No. 2005-234560, filed Aug. 12, 2005.

TECHNICAL FIELD

This disclosure relates to method for producing a two-piece can of a high strain level, such as an aerosol can, and to a two-piece laminated can of a high strain level.

BACKGROUND

Metal containers of aerosol are largely grouped into two-piece cans and three-piece cans. The two-piece can is a can structured by two segments, namely the can body integrated with the can bottom and the can end. The three-piece can is a can structured by three segments, namely the can body, the top end, and the bottom end. The two-piece can has no seam (welded part) so that it gives beautiful appearance. However, the two-piece can generally requires high strain. Since the three-piece can has the seam, it is inferior in appearance to the two-piece can. The three-piece can, however, generally requires low strain. Therefore, the two-piece can is widely used for small capacity and high grade goods in the market, and the three-piece can is generally used for large capacity and low price goods.

The metal base material for an aerosol two-piece can usually adopts expensive and thick aluminum sheet, and rarely uses steel sheet base material such as inexpensive and thin sheet, including tinplate and tin-free steel. The reason is that, since the aerosol two-piece can requires high strain, drawing and DI working are difficult to apply, while aluminum allows applying impact-molding applicable to soft metallic materials. In this situation, if the steel sheet base material such as tinplate and tin-free steel which are inexpensive and high strength even with a thin sheet thickness is applicable, the industrial significance becomes remarkably high.

Although there were many proposals of drawing and DI working methods of laminated steel sheet, there is no proposal of the method for manufacturing cans such as an aerosol two-piece can of large drawing ratio and high elongation in the can height direction.

For example, Examined Japanese Patent Publication No. 7-106394, Japanese Patent No. 2526725 and Japanese Patent Laid-Open No. 2004-148324 disclose the working methods for drawing and drawing-ironing for resin-laminated metal sheet. The strain level described in Examined Japanese Patent Publication No. 7-106394, Japanese Patent No. 2526725 and Japanese Patent Laid-Open No. 2004-148324, (drawing ratio in Examined Japanese Patent Publication No. 7-106394, Japanese Patent No. 2526725 and Japanese Patent Laid-Open No. 2004-148324), is lower than the range specified. This is because Examined Japanese Patent Publication No. 7-106394, Japanese Patent No. 2526725 and Japanese Patent Laid-Open No. 2004-148324 place the target to beverage cans, food cans, and the like, and beverage cans and food cans are the cans requiring lower strain than the desired range of strain level.

Japanese Patent No. 2526725 and Japanese Patent Laid-Open No. 2004-148324 describe that, aiming to gain the prevention of delamination of resin layer and the barrier property after working, a heat treatment is applied during working and/or at an interim stage of working, or at the final stage. Japanese Patent No. 2526725 uses an orientating thermoplastic resin, and Japanese Patent Laid-Open No. 2004-148324 uses a compound of saturated polyester and ionomer.

Examined Japanese Patent Publications Nos. 59-35344 and 61-22626 describe methods of relaxing internal stress mainly by applying heat treatment at or above the melting point of the resin, and describe the application of heat treatment at a stage after the can-forming. The strain level of the can is low suggested by the detailed description and by the description of examples.

Japanese Patent No. 2526725 proposes heat treatment to relax the internal stress and to enhance the orientation crystallization, which method has become common to beverage can and the like. Although Japanese Patent No. 2526725 does not give detailed description, the temperature of heat treatment is presumably at or below the melting point since the orientation crystallization is accelerated at or below the melting point. The description and the examples of Japanese Patent No. 2526725 show that the strain level is lower than the strain level specified.

Conventional technologies did not provide methods for manufacturing cans such as aerosol two-piece cans using laminated steel sheet applying high strain. Thus, we fabricated two-piece cans using laminated steel sheet applying high strain of the steps of drawing-ironing of the laminated steel sheet to form into a shape of a cylinder integrated with a bottom, followed by diametral reduction in the vicinity of opening of the cylinder, and found the occurrence of problems characteristic to high strain, specifically the problem of delamination and fracture of resin layer. Our efforts revealed the effectiveness of the heat treatment in qualitative view. However, sole heat treatment was not sufficient, and the delamination of resin layer unavoidably appeared in a zone of high strain. As a result, simple application of the related art did not solve the problem of delamination of the resin layer. In addition, there appeared a problem of deterioration of formability of the resin layer during the forming after the heat treatment.

It could therefore be advantageous to provide a method for producing a two-piece can in which delamination and fracture of a laminate resin layer can be prevented even when a can body of a high strain level such as an aerosol two-piece can is produced.

It could also be advantageous to provide a can body of a high strain level such as an aerosol two-piece can using a laminated steel sheet.

SUMMARY

We found that, in a high strain level forming required for aerosol two-piece cans, instead of performing continuous forming until the last stage, heat treatment should be performed under particular conditions at an intermediate stage of forming where a strain level is within a specified range so that delamination and fracture of the resin in the subsequent forming steps can be suppressed.

We thus provide a method for producing a two-piece can, comprising:

subjecting a circular disk of a laminated steel sheet having a thermoplastic resin coating layer to multistage forming to form a final formed body having a height h, a maximum radius r, and a minimum radius d (the case where r is equal to d is also included).

The method for producing the two-piece can is characterized by (A) and (B) below:

(A) The circular disk is formed so that the height h, maximum radius r, and the minimum radius d of the final formed body satisfy the relationships $0.1 \leqq d/R \leqq 0.25$ and $1.5 \leqq h/(R-r) \leqq 4$ with respect to a radius R of the circular disk, before forming, having the same weight to that of the final formed body; and (B) During the forming, a formed body is subjected to heat treatment at a temperature of not less than a melting point of a thermoplastic resin, but not more than a temperature 30° C. higher than the melting point.

The heat treatment may be performed a plurality of times during the forming.

The heat treatment preferably comprises heating the formed body to a temperature not less than the melting point of the thermoplastic resin and not more than a temperature 30° C. higher than the melting point in an intermediate forming stage where a height h, a maximum radius r, and a minimum radius d (the case where r is equal to d is also included) of the formed body at the intermediate stage satisfy relationships $0.2 \leqq d/R \leqq 0.5$ and $1.5 \leqq h/(R-r) \leqq 2.5$ with respect to the radius R.

The heat treatment in the intermediate forming stage may be performed a plurality of times.

The heat treatment is preferably performed for about 15 to about 120 seconds.

Furthermore, the steel sheet is preferably cooled to a temperature not more than the glass transition point Tg of the thermoplastic resin within 10 seconds from completion of the heat treatment.

The thermoplastic resin in the thermoplastic resin coating layer described above is preferably a polyester resin.

The polyester resin is preferably obtained by polycondensation of a dicarboxylic acid component and a diol component. The dicarboxylic acid component preferably contains terephthalic acid as a main component, and the diol component preferably contains ethylene glycol and/or butylene glycol as a main component. The dicarboxylic acid component preferably further contains isophthalic acid component as a comonomer, and the diol component preferably further contains diethylene glycol and/or cyclohexanediol as a comonomer.

The thermoplastic resin is preferably obtained by polycondensation of a dicarboxylic acid component and a diol component. The dicarboxylic acid component preferably contains terephthalic acid as a main component, and the diol component is preferably a mixed resin in which a main phase composed of a polyester containing ethylene glycol and/or butylene glycol as a main component and an auxiliary phase dispersed in the main phase and composed of a resin incompatible with the main phase and having a glass transition point (Tg) of 5° C. or less are mixed.

The dicarboxylic acid component preferably further contains an isophthalic acid component as a comonomer, and the diol component preferably further contains diethylene glycol and/or cyclohexanediol as a comonomer.

The auxiliary phase is preferably at least one type of resin selected from a polyethylene, a polypropylene, an acid-modified polyethylene, an acid-modified polypropylene, and an ionomer.

The thermoplastic resin coating layer preferably has a plane orientation factor of 0.06 or less.

The method for producing the two-piece can preferably comprises the following:

step (A) of drawing a disk-shaped blank to form a bottomed cylindrical formed body having a radius r of a can outer surface;

dome-forming step (B) of raising a bottom part of the formed body to give an upward concave shape so as to form a dome-shaped part;

step (C) of trimming an opening-side end part of the formed body; and step D of subjecting the opening of the formed body to diametral reduction to bring the opening-side of the formed body to a radius d of the can outer surface, thus obtaining a final formed body.

We also provide a two-piece can laminate can produced by the method for producing the two-piece can described above.

BRIEF DESCRIPTION OF THE DRAWING

FIG. 1 is a diagram describing one representative production method of a can body.

DETAILED DESCRIPTION

FIG. 1 illustrates a representative example of a manufacturing process of a can. A circular blank is formed into a formed body in a shape of a cylinder integrated with a bottom by drawing (including DI forming). The vicinity of opening of the formed body is subjected to diametral reduction to produce a two-piece can with a diametral reduction part in the vicinity of the opening.

In FIG. 1, reference symbol 1 is the circular disk blank (blank sheet) before forming, 2 is the straight wall part as the base part of the formed body, (in the step D, straight wall part not being worked by diametral reduction), 3 is the dome-shaped part, 4 is the straight wall part at the neck-shaped part being worked by diametral reduction, and 5 is the taper-shape part, or the tapered wall part after worked by diametral reduction.

First, the circular disk blank 1 is subjected to one or a plurality of steps of drawing (including DI forming) to form a formed body in a shape of a cylinder integrated with a bottom, having a specified can diameter (radius r: radius of outer face of can), (Step A). Then, the bottom part of the formed body is subjected to dome-forming, or to forming into an upward convex shape to form the dome-shaped part 3, (Step B). Further the edge of the opening of the formed body is trimmed, (Step C). Next, the opening of the formed body is subjected to one or a plurality of stages of diametral reduction to bring the opening side of the formed body to a specified can diameter (radius d: radius of the can outer face), thus obtaining the desired final formed body (two-piece can). In FIG. 1, the reference symbol $R_0$ is the radius of the circular disk blank 1 before forming, and h, r, and d are the height, the maximum radius, and the minimum radius of the formed body during forming or of the final formed body, respectively, and R is the radius of the circular disk, before forming, having equal weight to that of the final formed body. According to the manufacturing process of the two-piece can, Step A results in the maximum radius equal to the minimum radius, or r=d, while Step D results in r>d.

The radius R of the circular disk, before forming, having the same weight as that of the final formed body is determined based on the measured weight of the final formed body. That is, the weight of the final formed body is measured, and the size (radius) of the circular disk, before forming, having the same weight as the measured weight is determined, which determined size is used as the radius R of the circular disk, before forming, having the same weight as that of the final formed body. The can edge part is trimmed during the can manufacturing process. Since, however, the radius R of the circular disk, before forming, having the same weight as that of the final formed body eliminates the effect of the trimming, a more suitable evaluation of the strain is available.

On the two-piece can which is fabricated by the above drawing (including DI working) and diametral reduction applied to the circular disk blank, the resin layer is elongated in the height direction and compressed in the circumferential direction. When the strain level is high, deformation of the resin becomes large, which leads to fracture of the resin layer. The index of strain level is not only the parameter d/R representing the degree of compression, but also the parameter [h/(R−r)] relating to the elongation in the can height direction because the expression of strain level in a high strain zone needs to consider elongation in addition to the drawing ratio. That is, by specifying the strain level by both the degree of compression and the degree of elongation, the degree of deformation of the resin layer is quantified. By elongation in the height direction and compression in the circumferential direction, the resin layer tends to delaminate, thus, elongation in the height direction becomes an important variable adding to the degree of compression.

The strain level of the resulting manufactured can (final formed body) is specified so that the relation of the height h of the final formed body, the maximum radius r thereof, the minimum radius d thereof, and the radius R of circular disk, before forming, has the same weight as that of the final formed body, to satisfy [$0.1 \leqq d/R \leqq 0.25$] and [$1.5 \leqq h/(R-r) \leqq 4$].

As previously described it is advantageous to allow laminated steel sheet to manufacture high strain level of can which was difficult to be achieved by conventional technologies. It was difficult in conventional technologies to manufacture a high strain level of can that satisfies both the parameter d/R specifying the degree of compression not higher than 0.25 and the parameter [h/(R−r)] specifying the degree of elongation not smaller than 1.5 using laminated steel sheet. Consequently, we specify the strain level d/R of the manufacturing can as 0.25 or less, and specify [h/(R−r)] as 1.5 or more.

If the strain level is high such that the parameter d/R specifying the degree of compression not higher than 0.1 or the parameter [h/(R−r)] specifying the degree of elongation exceeding 4, the number of forming stages increases even if forming is available, or the sheet elongation reaches its limit by the progress of work hardening, which causes a sheet fracture problem. Therefore, we specify the strain level of manufacturing a can as [$0.1 \leqq d/R$] and [$h/(R-r) \leqq$]

The multiple stage forming may be any of drawing, drawing-ironing, diametral reduction, and combinations thereof. If the diametral reduction is included in working, the size d of the final formed body is [r>d]. If the diametral reduction is not included, the size of the final formed body is [r=d] (r and d are the radius of final formed body).

We specify the laminated steel sheet with a resin laminate as the metal sheet of base material.

Steel sheet is selected as the base metallic material because steel is less expensive and superior in economy to aluminum. The steel sheet can be ordinary tin-free steel or tinplate. Tin-free steel preferably has a metal chromium layer of about 50 to about 200 mg/m$^2$ of surface coating weight and a chromium oxide layer of about 3 to about 30 mg/m$^2$ of coating weight as metal chromium. Tinplate preferably has about 0.5 to about 15 g/m$^2$ of plating. The sheet thickness is not specifically limited, and that in a range from about 0.15 to about 0.30 mm, for example, is applicable. If no economic consideration is needed, the technology can simply apply also to aluminum base material.

The reason for limiting the resin layer to the thermoplastic resin is because the resin layer must follow the forming, and thermosetting resins are difficult to use. Among thermoplastic resins, polyesters are particularly preferable. This is because they achieve a good balance between elongation and strength. Although olefin resins are usable, those olefin resins which have a low strength are not suited for ironing and are preferably used when no ironing is performed.

The targeted forming region is a high forming region in which the strain level is higher than the related art, that is, a region in which the compression in the circumferential direction is large. The film is not only compressed significantly in the circumferential direction, but also elongated significantly in the height direction. Thus, the thickness changes, resulting in three-dimensional deformation. In forming in the high-strain level region, delamination of the resin layer is inevitable due to a sharp increase in internal stresses unless heat treatment is performed in the course of forming. Although it is effective for high strain forming to perform heat treatment in the course of forming, the formability is degraded as a result by orientation crystallization. In particular, when elongation in the height direction and compressive deformation in the circumferential direction are large, orientation of the resin increases in the height direction. As the orientation progresses, internal stresses increase and the film becomes more easily delaminated and, as the bonding force in the circumferential direction decreases, the likelihood of film fracture increases.

The heat treatment relaxes internal stresses generated by forming so that forming in the subsequent step can be carried out. In particular, heat treatment is performed to recover the adhesion force and reduce orientation. The objective of the heat treatment in the related art described above is to relax the internal stresses or promote orientation. That approach is completely opposite of our approach.

As forming progresses, the resin layer becomes more and more oriented in the forming direction and formability is degraded as a result. To prevent this, the resin layer is heated at a temperature not less than the melting point of the thermoplastic resin so that the resin layer enters a non-oriented state (or a state close to a non-oriented state). As a result of forming, internal stresses accumulate in the resin layer. To put it simply, the accumulated internal stresses are the force that renders the layer compressed when the layer is elongated or elongated when the layer is compressed. The resin layer is urged by this force to deform, but cannot deform because the resin layer is adhered on the base metal sheet. Accordingly, if the adhesion force is weak, the resin will delaminate due to this force. On the contrary, if the internal stresses are so large that the layer cannot be supported by the adhesion force, the resin layer will delaminate. By conducting heat-treatment at a temperature not less than the melting point of the resin, this can be moderated as the molecules become rearranged.

The upper limit temperature of the heat treatment is limited to a temperature 30° C. higher than the melting point of the polyester resin. This is because when the temperature exceeds a temperature 30° C. higher than the melting point, the film surface becomes rough, and not only appearance is degraded as a result, but also the formability in the subsequent steps is adversely affected. By conducting the heat treatment, the resin regains the formability and can be made suitable for forming in the subsequent steps.

The timing of the heat treatment is preferably an intermediate forming stage where the height h, the maximum radius r, and the minimum radius d (the case where r is equal to d is also included) of the formed body at an intermediate stage satisfy relationships $0.2 \leqq d/R \leqq 0.5$ and $1.5 \leqq h/(R-r) \leqq 2.5$ with respect to the radius R. When the strain level is within this range, the heat treatment is most effective from the viewpoint of preventing the fracture and delamination of the resin layer. In other words, if the heat treatment is conducted at the stage involving a low strain level, the above-described effects are small because relaxation of the internal stresses is conducted at the stage where the internal stresses are not high. Moreover, orientation crystallization is accelerated and formability is degraded. Furthermore, if the heat treatment is conducted at a stage involving an excessively high strain level, the adhesion force is decreased, and delamination may occur as a result, which sometime makes the timing of the heat treatment too late. The upper and lower limits of the strain level are specified as above from these viewpoints.

The heat treatment may be conducted in one or both of Step A and Step D of the method shown in FIG. 1. With respect to the timing of the heat treatment described above, the reason why the case in which R is equal to d is included is because, in the can production method including diametral reduction, the heat treatment can be performed in Step A and, in the can production method not including diametral reduction, r is equal to d. The heat treatment may be conducted two or more times in two or more intermediate stages if there is a necessity of relaxing the internal stresses.

It is preferable to cool the steel sheet to a temperature not more than the glass transition point Tg of the thermoplastic resin within 10 seconds from the completion of the heat treatment. This is to avoid formation of spherulites during the cooling step. When the cooling rate is low, there is a greater tendency of developing spherulites in the resin. Since the spherulites degrade formability, the steel sheet is cooled to a temperature not more than glass transition point Tg within 10 seconds from the completion of the heat treatment depending on the strain level and the purpose of use.

The method of heat treatment is not particularly limited. It has been confirmed that similar effects can be obtained from electrical furnaces, gas ovens, infrared furnaces, induction heaters, and the like. Moreover, the heating rate and the heating time may be adequately selected according to the effects. The efficiency is higher when the heating rate is high. The heating time is typically about 15 second to about 60 seconds, but is not limited to this range. The heating time may be adequately selected according to the effect.

If the cooling rate after completion of the heat treatment is low, spherulites may grow in the resin. The spherulites degrade the formability. To prevent formation of spherulites during cooling, it is preferable to quench the steel sheet to a temperature not more than the glass transition point Tg within 10 seconds from the completion of the heat treatment.

It was found that for the resin layer to follow the deformation at a high strain level, the initial orientation of the laminated steel sheet is also important. That is, while a film prepared by biaxial stretching or the like is oriented in a planar direction, if the film retains a highly oriented state even after lamination, the film cannot follow the forming, thereby possibly resulting in fracture. From this viewpoint, the plane orientation factor of the resin layer is preferably 0.06 or less. Since the heat treatment extinguishes (or moderates) orientation of the resin layer, working is possible even when the plane orientation factor is higher than the defined value depending on the timing of the heat treatment. However, in such a case, the timing of the heat treatment must be made earlier, and thus the efficiency is low. From these standpoints, the plane orientation factor is preferably 0.06 or less.

To form such a laminated steel sheet by using a biaxially stretched film having a high plane orientation factor, the temperature during lamination should be increased so that the oriented crystals are thoroughly melted. Alternatively, a film formed by extrusion has nearly no orientation and is thus preferable from this standpoint. Similarly, a direct lamination method by which molten resin is directly laminated with a steel sheet is preferable for the same reason.

For the laminated steel sheet, from the standpoints of the elongation and strength required for forming, polyester resin is preferably a resin obtained by polycondensation of a carboxylic acid component and a diol component, in which the dicarboxylic acid component contains terephthalic acid as the main component and optionally an isophthalic acid component as another comonomer and in which the diol component contains ethylene glycol and/or butylene glycol as the main component and optionally diethylene glycol and/or cyclohexanediol as another comonomer.

Alternatively, the resin layer is preferably a mixed resin containing a main phase composed of the above-described resin and an auxiliary phase dispersed in the main phase, the auxiliary phase being composed of a resin incompatible with the main phase and having a glass transition point (Tg) of 5° C. or less. In the case where the resin dispersed in the main phase has a glass transition point exceeding 5° C., the resin may not easily deform when subjected to working. However, in the case where a resin having a glass transition point of 5° C. or less is used, the resin easily deforms by forming and the adhesion of the resin layer after the working can be improved.

At least one selected from a polyethylene, a polypropylene, an acid-modified polyethylene, an acid-modified polypropylene, and an ionomer can be used as the dispersed resin incompatible with the main phase and having a glass transition point (Tg) of 5° C. or less.

If the volume ratio of the auxiliary phase in the mixed resin in which the main phase and the auxiliary phase are mixed is less than 3 vol %, the effect of the auxiliary phase cannot be sufficiently expressed, and at a ratio exceeding 30 vol %, the auxiliary phase grains cannot stably exist in the resin layer. Thus, the volume ratio of the auxiliary phase in the mixed resin is preferably about 3 vol % or more and about 30 vol % or less.

The laminated steel sheet may be used while adding additives such as a pigment, a lubricant, a stabilizer, or the like, in the resin layer. Alternatively, another resin layer having another function may be provided in addition to the resin layer so that this another resin layer is disposed on the resin layer or as an intermediate layer between the resin layer and the base steel sheet.

The thickness of the resin layer is not particularly limited, but is preferably in about 10 μm or more and about 50 μm or less. This is due to the following reasons. In the case of film lamination, the cost of film less than 10 μm is usually high. The formability can be improved as the film thickness increases but the cost also increases. At a thickness exceeding 50 μm, the contribution to the formability is saturated and cost is high.

In the laminated steel sheet, at least one surface of the steel sheet should be coated with the resin layer.

Furthermore, the lamination method for the steel sheet is not particularly limited. Any suitable method such as heat lamination in which a biaxially stretched film or an unstretched film is thermally press-bonded or extrusion in which a resin layer is directly formed on the steel sheet using a T-die or the like may be employed. It has been confirmed that satisfactory effects can be obtained in either case.

EXAMPLE 1

Examples will now be described.

"Preparation of Laminated Steel Sheet"

A 0.20 mm-thick T4CA, TFS (metallic chromium layer: 120 mg/m$^2$, chromium oxide layer: 10 mg/m$^2$ on metallic chromium basis) was used as the substrate metal sheet. Various resin layers were formed on this sheet by a film lamination technique (heat lamination method) and a direct lamination method (direct extrusion method). As for the film lamination, two types of films, a biaxially oriented film and a non-oriented film, were used. Films each having a thickness of 25 μm were laminated on both sides of the metal sheet.

The plane orientation factor of the laminate film on the laminated steel sheet prepared as above was calculated by the method below.

"Measurement of Plane Orientation Factor"

Abbe's refractometer was used to determine the refractive index under the condition of: light source of sodium/D ray; intermediate liquid of methylene iodide; and temperature of 25° C. The determined refractive indexes were Nx in the machine direction, Ny in the transverse direction, and Nz in the thickness direction of the film. Then, the plane orientation factor Ns was calculated by the following formula:

$$\text{Plane orientation factor}(Ns)=(Nx+Ny)/2-Nz.$$

The method for producing the laminated steel sheet and the details of the laminated steel sheet fabricated are shown in Table 1. The types of resins described in Table 1 are as follows:

PET: polyethylene terephthalate

PET-I (5): polyethylene terephthalate-isophthalate copolymer (isophthalic acid copolymerization ratio: 5 mol %)

PET-I (12): polyethylene terephthalate-isophthalate copolymer (isophthalic acid copolymerization ratio: 12 mol %)

PET-PBT (60): polyethylene terephthalate-butylene terephthalate copolymer (butylene terephthalate copolymerization ratio: 60 mol %)

PET-DEG: polyethylene terephthalate-diethylene glycol copolymer

PET-CHDM: polyethylene terephthalate-cyclohexanediol copolymer

PBT: polybutylene terephthalate

PET-PE: PET is the main phase and polyethylene (Tg: −125° C.) is the auxiliary phase, where the polyethylene content is 15 vol %.

PET-PP: PET is the main phase and polypropylene (Tg: −20° C.) is the auxiliary phase, where the polypropylene content is 13 vol %.

PET-IO: PET is the main phase and ionomer (ethylene-unsaturated carboxylic acid copolymer neutralized with Zn, Tg: −30° C. or lower) is the auxiliary phase, where the ionomer content is 14 vol %.

The lamination methods are the following:

Heat lamination method 1: A film prepared by the biaxial orientation method was thermocompressed on a steel sheet which was heated to [the melting point of resin +10° C.] using a nip roll. Then the film was cooled within 7 seconds by water.

Heat lamination method 2: A non-oriented film was thermocompressed on a steel sheet which was heated to [the melting point of resin+10° C.] using a nip roll. Then the film was cooled within 7 seconds by water.

Direct extrusion method: Resin pellets were kneaded and melted in an extruder, which were then extruded through a T-die to laminate onto a running steel sheet. The steel sheet with the resin laminate was nip-cooled on a cooling roll at 80° C., and was further cooled by water.

The lamination techniques were as follows:

A coated steel sheet of a comparative example was formed by applying an epoxy thermosetting resin and heating the steel sheet at 220° C. for 10 minutes to form a coating having a thickness of 8 μm.

TABLE 1

| Sample steel sheet No | Type of resin | Melting point ° C. | Lamination method | Plane orientation factor | Remarks |
|---|---|---|---|---|---|
| A1 | PET-I (12) | 228 | Heat lamination method 1 | 0.02 | Invention steel sheet example |
| A2 | PET-I (5) | 245 | Heat lamination method 1 | 0.02 | Invention steel sheet example |
| A3 | PET | 258 | Heat lamination method 1 | 0.02 | Invention steel sheet example |
| A4 | PET-PBT (60) | 251 | Heat lamination method 1 | 0.02 | Invention steel sheet example |
| A5 | PBT | 220 | Heat lamination method 1 | 0.02 | Invention steel sheet example |
| A6 | PET-I (12) | 228 | Heat lamination method 1 | 0.04 | Invention steel sheet example |
| A7 | PET-PE | 258 | Heat lamination method 1 | <0.01 | Invention steel sheet example |
| A8 | PET-PP | 258 | Heat lamination method 1 | <0.01 | Invention steel sheet example |
| A9 | PET-IO | 258 | Heat lamination method 1 | <0.01 | Invention steel sheet example |
| A10 | PET-I (12) | 228 | Heat lamination method 2 | 0.02 | Invention steel sheet example |
| A11 | PET-I (12) | 228 | Direct Extrusion method | 0.02 | Invention steel sheet example |
| A12 | PET-I (12) | 228 | Heat lamination method 1 | 0.06 | Invention steel sheet example |
| A13 | PET-PBT (60) | 251 | Heat lamination method 2 | <0.01 | Invention steel sheet example |

TABLE 1-continued

| Sample steel sheet No | Type of resin | Melting point ° C. | Lamination method | Plane orientation factor | Remarks |
|---|---|---|---|---|---|
| A14 | PET-DEG | 248 | Heat lamination method 2 | <0.01 | Invention steel sheet example |
| A15 | PET-CHDM | 249 | Heat lamination method 2 | <0.01 | Invention steel sheet example |
| A16 | Epoxy thermosetting resin | — | Application | — | Comparative steel sheet example |

"Forming of Can Body"

The resulting sample steel sheet was used to form a can body (final formed body) by the procedure below according to the production method shown in FIG. 1. The profiles of the intermediate formed body (Step C) and the final formed body (Step D) are described in Table 2. The drawing in Step A was conducted in 5 stages, and the diametral reduction in Step D was conducted in 7 stages. The heat treatment was conducted during Steps A to D, and the can body was heated in an infrared furnace and cooled with water after the heat treatment. The timing of the heat treatment (strain level of the can body during the heat treatment) and the heat treatment conditions are shown in Table 3.

In Table 2, h, r, d, ha, hc, and R of the final formed body (Step D) respectively denote, the height to the opening end portion, the diameter of the base portion 2, the diameter of the neck-shaped portion 3, the height of the base portion 2, the height of the neck-shaped portion 3, and the radius of the disk-shaped blank before forming whose weight is equivalent to that of the final formed body (see FIG. 1). The radius R of the disk-shaped blank was measured as follows. The weight of the blank sheet before forming and the weight of the final formed body after the trimming step were measured, and, on the basis of the measurement results, the radius of the blank sheet before forming that can render the weight of the blank sheet to be equal to the weight of the final formed body was calculated, and the given radius was assumed to be the radius R of the disk-shaped blank before forming whose weight is equivalent to that of the final formed body.

TABLE 2

| | | Intermediate formed body (Step C) | | Final formed body (Step D) | | | | | | | | Rate of change in |
|---|---|---|---|---|---|---|---|---|---|---|---|---|
| Can profile | Blank radius $R_O$ (mm) | r (mm) | h (mm) | r (mm) | d (mm) | h (mm) | ha (mm) | hc (mm) | Blank radius R* (mm) | d/R | h/(R-r) | sheet thickness** |
| B1 | 41 | 11 | 63.6 | 11 | 7.8 | 65.9 | 47 | 9.9 | 40.4 | 0.19 | 2.24 | 1.20 |
| B2 | 33 | 11 | 63.5 | 11 | 7.8 | 65.9 | 47 | 9.9 | 32.2 | 0.24 | 3.11 | 0.65 |

*Blank radius R is determined from the weight of the end product.

**Sheet thickness of the thinnest portion of the can/sheet thickness of the blank sheet. The thickness is the thickness of the steel sheet in all

TABLE 3

| Can No. | Sample steel sheet No. | Resin layer melting point ° C. | Strain level during heat treatment d/R | h/(R − r) | Heat treatment conditions Temperature (° C.) | Temperature (sec) | Cooling time* (sec) | Final profile of can | Film formability | Film adhesiveness | Remarks |
|---|---|---|---|---|---|---|---|---|---|---|---|
| C1 | A1 | 228 | 0.30 | 1.50 | 238 | 30 | 8 | B1 | • | ○ | Invention example |
| C2 | A1 | 228 | 0.30 | 1.50 | 238 | 60 | 8 | B1 | • | ○ | Invention example |
| C3 | A1 | 228 | 0.30 | 1.50 | 238 | 90 | 8 | B1 | • | ○ | Invention example |
| C4 | A1 | 228 | 0.30 | 1.50 | 238 | 120 | 8 | B1 | • | ○ | Invention example |
| C5 | A1 | 228 | 0.30 | 1.50 | 255 | 30 | 8 | B1 | • | ○ | Invention example |
| C6 | A1 | 228 | 0.30 | 1.50 | 248 | 30 | 8 | B1 | • | ○ | Invention example |
| C7 | A1 | 228 | 0.30 | 1.50 | 228 | 30 | 8 | B1 | • | ○ | Invention example |
| C9 | A1 | 228 | 0.30 | 1.50 | 238 | 30 | 1 | B1 | • | ○ | Invention example |
| C10 | A1 | 228 | 0.30 | 1.50 | 238 | 30 | 2 | B1 | • | ○ | Invention example |
| C11 | A1 | 228 | 0.30 | 1.50 | 238 | 30 | 4 | B1 | • | ○ | Invention example |
| C12 | A1 | 228 | 0.30 | 1.50 | 238 | 30 | 6 | B1 | • | ○ | Invention example |

TABLE 3-continued

| Can No. | Sample steel sheet No. | Resin layer melting point ° C. | Strain level during heat treatment d/R | Strain level during heat treatment h/(R − r) | Heat treatment conditions Temperature (° C.) | Heat treatment conditions Temperature (sec) | Cooling time* (sec) | Final profile of can | Film formability | Film adhesiveness | Remarks |
|---|---|---|---|---|---|---|---|---|---|---|---|
| C13 | A1 | 228 | 0.30 | 1.50 | 238 | 30 | 15 | B1 | ○ | ○ | Invention example |
| C14 | A1 | 228 | 0.38 | 1.79 | 238 | 30 | 8 | B1 | • | ○ | Invention example |
| C15 | A1 | 228 | 0.23 | 2.20 | 238 | 30 | 8 | B1 | • | ○ | Invention example |
| C16 | A1 | 228 | 0.47 | 1.55 | 238 | 30 | 8 | B1 | • | ○ | Invention example |
| C17 | A1 | 228 | 0.40 | 2.60 | 238 | 30 | 8 | B2 | ○ | ○ | Invention example |
| C18 | A1 | 228 | 0.35 | 2.90 | 238 | 30 | 8 | B2 | ○ | ○ | Invention example |
| C19 | A1 | 228 | 0.23 | 3.05 | 238 | 30 | 8 | B2 | ○ | ○ | Invention example |
| C20 | A2 | 245 | 0.30 | 1.50 | 255 | 30 | 8 | B1 | • | ○ | Invention example |
| C21 | A3 | 258 | 0.30 | 1.50 | 268 | 30 | 8 | B1 | • | ○ | Invention example |
| C22 | A4 | 251 | 0.30 | 1.50 | 261 | 30 | 8 | B1 | • | ○ | Invention example |
| C23 | A5 | 220 | 0.30 | 1.50 | 238 | 30 | 8 | B1 | • | ○ | Invention example |
| C24 | A6 | 228 | 0.30 | 1.50 | 238 | 30 | 8 | B1 | • | ○ | Invention example |
| C25 | A7 | 258 | 0.30 | 1.50 | 268 | 30 | 8 | B1 | • | ○ | Invention example |
| C26 | A8 | 258 | 0.30 | 1.50 | 268 | 30 | 8 | B1 | • | ○ | Invention example |
| C27 | A9 | 258 | 0.30 | 1.50 | 268 | 30 | 8 | B1 | • | ○ | Invention example |
| C28 | A10 | 228 | 0.30 | 1.50 | 238 | 30 | 8 | B1 | • | ○ | Invention example |
| C29 | A11 | 228 | 0.30 | 1.50 | 238 | 30 | 8 | B1 | • | ○ | Invention example |
| C30 | A12 | 228 | 0.30 | 1.50 | 238 | 30 | 8 | B1 | ○ | ○ | Invention example |
| C31 | A13 | 251 | 0.30 | 1.50 | 261 | 30 | 8 | B1 | • | ○ | Invention example |
| C32 | A14 | 248 | 0.30 | 1.50 | 258 | 30 | 8 | B1 | • | ○ | Invention example |
| C33 | A15 | 249 | 0.30 | 1.50 | 259 | 30 | 8 | B1 | • | ○ | Invention example |
| C34 | A16 | — | 0.30 | 1.50 | 238 | 30 | 8 | B1 | x | x | Comparative |
| C35 | A1 | 228 | 0.30 | 1.50 | 220 | 30 | 8 | B1 | x | x | Comparative |

*Time taken until the temperature is reduced to Tg or less after completion of the heat treatment.

1) Blanking (66 to 82 mm ϕ)

2) Drawing and Ironing (Step A)

A can body (intermediate can body) having a radius r and a height h satisfying the ranges of d/R of 0.27 to 0.34 and h/(R−r) of 2.23 to 3.09 was manufactured by 5-stage drawing. In order to make a desired can, ironing was also employed where necessary.

3) Dome Forming in the Can Bottom Portion (Step B)

The can bottom portion was raised to form a hemisphere having a depth of 6 mm.

4) Trimming (Step C)

The upper end portion of the can was trimmed by about 2 mm.

5) Diametral Reduction at Opening Portion of the Cylinder (Step D)

The upper portion of the cylinder was subjected to diametral reduction. In particular, the diametral reduction was conducted by a die-neck method in which a die having a tapered inner face was pressed against the opening end portion to produce a can having a final profile described in Table 2.

The adhesiveness, formability, and appearance of the film layer of the can body made by the above-described procedure were evaluated as follows. The results of the evaluation are also shown in Table 3.

"Adhesiveness Test"

A can body was sheared into a substantially rectangular shape sheet elongating in the can height direction so that the length in the circumferential direction was 15 mm. At a position 10 mm from the bottom in the can height direction, the steel sheet only was sheared along a straight line in the circumferential direction. As a result, a test piece was obtained which was constituted from the part 10 mm from the bottom surface in the can height direction and the remainder, the boundary of the 10 mm portion and the remainder being the shearing position. A steel sheet having a width of 15 mm and a length of 60 mm was connected (welded) to the 10 mm part, and the film in the remainder portion was separated for about 10 mm from the sheared position while holding the 60 mm steel sheet part. A 1800 peeling test was then conducted while using the part where the film was separated and the 60 mm steel part as grips. The minimum value of the peel strength observed was used as the index of the adhesiveness.

"Peel Strength"

Less than 6 N/15 mm: x

6 N/15 mm or more: ○

"Evaluation of Film Formability"

A seal with a small opening of 15 mm ϕ was attached around the position 10 mm from the upper end of the can so that the measurement area was 15 mm ϕ. The portion exposed in the small opening was dipped in an electrolyte (KCl: 5% solution, temperature: normal temperature), and a voltage of 6.2 V was applied between the steel sheet and the electrolyte. Evaluation was conducted according to the value of the current detected as described below.

"Current Value"

0.01 mA or less: ◎

More than 0.01 mA but not less than 0.1 mA: ○

More than 0.1 mA: x

"Results of Evaluation"

Can bodies C1 to C7 and C8 to C33 are Examples. They exhibited satisfactory values in both film adhesiveness and formability.

Among the Examples, evaluation of formability is higher for samples in which the cooling time after completion of the heat treatment is 10 sec or less than samples in which the cooling time was more than 10 sec (can body C13). Can bodies C17 to C19 are Examples, but the timing of the heat treatment is outside the preferred range. Their film formability and adhesiveness were both "pass," but the evaluation of the formability was only ○.

Can body C34 is a comparative example. The resin layer was formed by application using a thermosetting paint, and both formability and adhesiveness were x.

In Can C35, the heat treatment temperature was outside our range. The form ability was x.

What is claimed is:

1. A method for producing a two-piece can, wherein a circular disk of a laminated steel sheet having a thermoplastic resin coating layer is subjected to multistage forming to form a final formed body having a height h, a maximum radius r, and a minimum radius d, wherein r may be equal to d, comprising:

forming the circular disk so that the height h, maximum radius r, and the minimum radius d of the final formed body satisfy the relationships $0.1 \leqq d/R \leqq 0.25$ and $1.5 \leqq h/(R-r) \leqq 4$ with respect to a radius R of the circular disk, before forming, having the same weight as that of the final formed body; and during the forming, subjecting a formed body to heat treatment at a temperature of not less than a melting point of the thermoplastic resin, but not more than a temperature 30° C. higher than the melting point.

2. The method according to claim 1, wherein the heat treatment comprises heating the formed body to a temperature not less than the melting point of the thermoplastic resin and not more than a temperature 30° C. higher than the melting point in an intermediate segment of the forming stage where a height h, a maximum radius r, and a minimum radius d where r may be equal to d, of the formed body at the intermediate stage satisfy relationships $0.2 \leqq d/R \leqq 0.5$ and $1.5 \leqq h/(R-r)$ 2.5 with respect to the radius R.

3. The method according to claim 1, wherein the heat treatment is performed a plurality of times during the forming.

4. The method according to claim 3, wherein the heat treatment is performed a plurality of times during an intermediate segment of the forming stage.

5. The method according to claim 1, wherein the heat treatment is performed for about 15 to about 120 seconds.

6. The method according to claim 2, wherein the heat treatment is performed for about 15 to about 120 seconds.

7. The method according to claim 1, wherein the steel sheet is cooled to a temperature not more than a glass transition point Tg of the thermoplastic resin within 10 seconds from completion of the heat treatment.

8. The method according to claim 1, wherein the thermoplastic resin is a polyester resin.

9. The method according to claim 8, wherein the polyester resin is obtained by polycondensation of a dicarboxylic acid component and a diol component, the dicarboxylic acid component contains terephthalic acid as a main component, and the diol component contains ethylene glycol and/or butylene glycol as a main component.

10. The method according to claim 9, wherein the dicarboxylic acid component further comprises isophthalic acid component as a comonomer, and the diol component further comprises diethylene glycol and/or cyclohexanediol as a comonomer.

11. The method according to claim 1, wherein the thermoplastic resin is obtained by polycondensation of a dicarboxylic acid component and a diol component, the dicarboxylic acid component contains terephthalic acid as a main component, and the diol component is a mixed resin in which a main phase composed of a polyester comprising ethylene glycol and/or butylene glycol as a main component and an auxiliary phase dispersed in the main phase and composed of a resin incompatible with the main phase and having a glass transition point (Tg) of 5° C. or less are mixed.

12. The method according to claim 11, wherein the dicarboxylic acid component further comprises an isophthalic acid component as a comonomer, and the diol component further comprises diethylene glycol and/or cyclohexanediol as a comonomer.

13. The method according to claim 11, wherein the auxiliary phase is at least one type of resin selected from the group consisting of a polyethylene, a polypropylene, an acid-modified polyethylene, an acid-modified polypropylene, and an ionomer.

14. The method according to claim 1, wherein the thermoplastic resin coating layer has a plane orientation factor of 0.06 or less.

15. The method according to claim 1, comprising:

drawing a disk-shaped blank to form a formed body in a shape of a cylinder integrated with a bottom, having a radius r of a can outer surface;

forming at least a portion of the bottom into an upward convex shape to form a dome-Shaped part;

trimming an edge of an opening in the formed body; and subjecting the opening to diametral reduction to bring an opening-side of the formed body to a radius d of the can outer surface to obtain a final formed body.

* * * * *